US009689636B2

(12) United States Patent
Randall

(10) Patent No.: US 9,689,636 B2
(45) Date of Patent: Jun. 27, 2017

(54) RECOIL REDUCING MUZZLE BRAKE

(71) Applicant: Edward Rigor Randall, Palm Harbor, FL (US)

(72) Inventor: Edward Rigor Randall, Palm Harbor, FL (US)

( * ) Notice: Subject to any disclaimer, the term of this patent is extended or adjusted under 35 U.S.C. 154(b) by 0 days.

(21) Appl. No.: 15/014,448

(22) Filed: Feb. 3, 2016

(65) Prior Publication Data

US 2016/0223281 A1 Aug. 4, 2016

Related U.S. Application Data

(60) Provisional application No. 62/111,375, filed on Feb. 3, 2015.

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/34
USPC ..... 89/14.2–14.5
See application file for complete search history.

(56) References Cited

U.S. PATENT DOCUMENTS

| | | | | | |
|---|---|---|---|---|---|
| 1,390,658 | A * | 9/1921 | Towson | F41A 21/36 | 89/14.3 |
| 1,605,393 | A * | 11/1926 | Cutts, Jr. | F41A 21/36 | 89/14.3 |
| 2,212,685 | A * | 8/1940 | Hughes | F41A 21/36 | 89/14.3 |
| 2,567,826 | A * | 9/1951 | Prache | F41A 21/36 | 89/14.3 |
| 4,307,652 | A * | 12/1981 | Witt | F41A 21/36 | 89/14.3 |
| 4,545,285 | A * | 10/1985 | McLain | F41A 21/36 | 89/14.3 |
| 5,675,107 | A * | 10/1997 | Ledys | F41A 21/36 | 89/14.05 |
| 2005/0252365 | A1* | 11/2005 | Balbo | F41A 21/36 | 89/14.3 |

* cited by examiner

*Primary Examiner* — Reginald Tillman, Jr.
(74) *Attorney, Agent, or Firm* — Dunlap Bennett & Ludwig PLLC

(57) ABSTRACT

A muzzle brake that will remove 80-90% of rifle recoil is disclosed. The invention uses cone shaped nozzles similar to rocket nozzles to expand the gasses properly in the correct direction to eliminate most of the rifle recoil and muzzle climb. The marksman can keep his rifle on target and fire all day without having a sore shoulder.

12 Claims, 3 Drawing Sheets

RECOIL REDUCING MUZZLE BRAKE

CROSS-REFERENCE TO RELATED APPLICATION

This application claims the benefit of priority of U.S. provisional application No. 62/111,375, filed Feb. 3, 2015, the contents of which are herein incorporated by reference.

BACKGROUND OF THE INVENTION

The present invention relates to weapons that discharge a round by rapidly expanding gasses provided by the ignition of a propellant, more particularly, to a muzzle brake for such weapons.

When a weapon is fired, the weapon moves in the opposite direction of the projectile's exit from the barrel. For firearms, such as rifles, the recoil of the rifle will cause the butt or stock of the rifle to impact the shooter's shoulder. The recoil can cause a sore shoulder and has a tendency to reduce a shooter's accuracy.

For large caliber weapons, such as machine guns, cannons, and howitzers, the substantial recoil forces encountered by such systems require large structural components or systems to absorb or otherwise dissipate the recoil forces generated by the weapon system. This may add substantial weight and complexity to the weapon system, as well as contributing to lifecycle costs of repair or replacement of components that become fatigued through repeated firing of the weapon.

Other muzzle brakes available in the art of firearms use flat plates or round holes that are formed in the ends of the barrel in order to reduce recoil and limit muzzle climb. Flat plates are inefficient at producing a counteracting force and cause noise from the gas impinging on the plates. On the other hand, while round holes drilled in the weapon barrel can limit muzzle climb, they are relatively ineffective at reducing the firearm's recoil.

As can be seen, there is a need for an improved muzzle brake to reduce recoil and muzzle climb.

SUMMARY OF THE INVENTION

In one aspect of the present invention, a muzzle brake comprises: a generally cylindrical body having an attachment end portion and a firing end portion opposite the attachment end; a bore defined through the generally cylindrical body and extending between the attachment end and the firing end; a plurality of protrusions extending from a lateral surface of the generally cylindrical body; and a nozzle having diverging sidewalls defined in the plurality of protrusions, the nozzle having a throat proximal and in fluid communication with the bore and an exit distal from the bore. In some embodiments, a longitudinal axis of the nozzle is aligned between about 35 to 55 degrees from a longitudinal axis of said bore. In other embodiments, a longitudinal axis of the nozzle is aligned at about 45 degrees from a longitudinal axis of the bore. In a preferred embodiment, the diverging sidewalls have an angle of between about 8-15 degrees from a longitudinal axis of the nozzle, and preferably about 12 degrees. In yet other embodiments, a longitudinal axis of the nozzle is elevated between about 5 and 15 degrees from a longitudinal axis of said bore, preferably about 10 degrees. In other preferred configurations, a longitudinal axis of the nozzle intersects a central axis of said bore. The longitudinal axis of the nozzle may also intersect the central axis of said bore intermediate the attachment end and the firing end of the muzzle brake.

In other aspects of the invention, a muzzle brake comprises: a generally cylindrical body having an attachment end portion and a firing end portion opposite the attachment end. A bore is defined through the generally cylindrical body and extends between the attachment end and the firing end. A plurality of nozzles, having a diverging sidewall, extend through a lateral side of the cylindrical body, the plurality of nozzles have a throat proximal and in fluid communication with the bore and an exit distal from the bore.

The nozzles are adapted to develop a thrust from a source of expanding gas passing through the throat from within the bore. In some embodiments, the nozzles are oriented to direct a first portion of the thrust towards the firing end. In other embodiments, the nozzles are also oriented to direct a second portion of the thrust in a downward direction. A longitudinal axis of the plurality of nozzles intersect at the longitudinal axis of the bore. The muzzle brake is configured such that the attachment end is adapted to receive the muzzle of a weapon barrel.

In yet another aspect of the present invention, a muzzle brake comprises a generally cylindrical body, having an attachment end portion and a firing end portion opposite the attachment end portion; the bore is defined through the generally cylindrical body and extends between the attachment end and the firing end; and a plurality of nozzles having a diverging sidewall. The plurality of nozzles extend through a lateral side of the cylindrical body. The plurality of nozzles having a throat proximal and in fluid communication with the bore and an exit opening distal from the bore and having a diameter larger than the throat. The nozzle preferably has a longitudinal axis aligned to intersect a longitudinal axis of the bore near the firing end and extending rearward from the firing end. The nozzle is adapted to develop a thrust from a source of expanding gas passing through the throat from within the bore.

In certain preferred embodiments, an axis of the nozzle is elevated with respect to the longitudinal axis of the bore by an angle of between about 5-15 degrees. The axis of the nozzle may also extend laterally at an angle of between about 35-55 degrees from the longitudinal axis of the bore.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a muzzle brake that reduces the recoil of a weapon, such as a rifle, cannon, a howitzer, whether the barrel is rifled or smooth bored. The present invention allows for proper expansion of the gases produced by the ignition of the propellant charge to propel the projectile, round or bullet, through the weapon's barrel. The muzzle brake is designed to generate enough force at the correct time to eliminate most of the weapon's recoil. The muzzle brake of the invention uses a plurality of cone shaped nozzles, similar in shape to a rocket nozzle, in order to expand the gasses properly in the correct direction to eliminate most of the weapon recoil and muzzle climb.

A non-limiting example of an embodiment of a muzzle brake will be provided in reference to a rifle. However, the design and performance characteristics are equally applicable to larger weapon systems, such as cannons (aircraft, land, or sea based), howitzers, used as the main gun of a tank.

Figure 1:
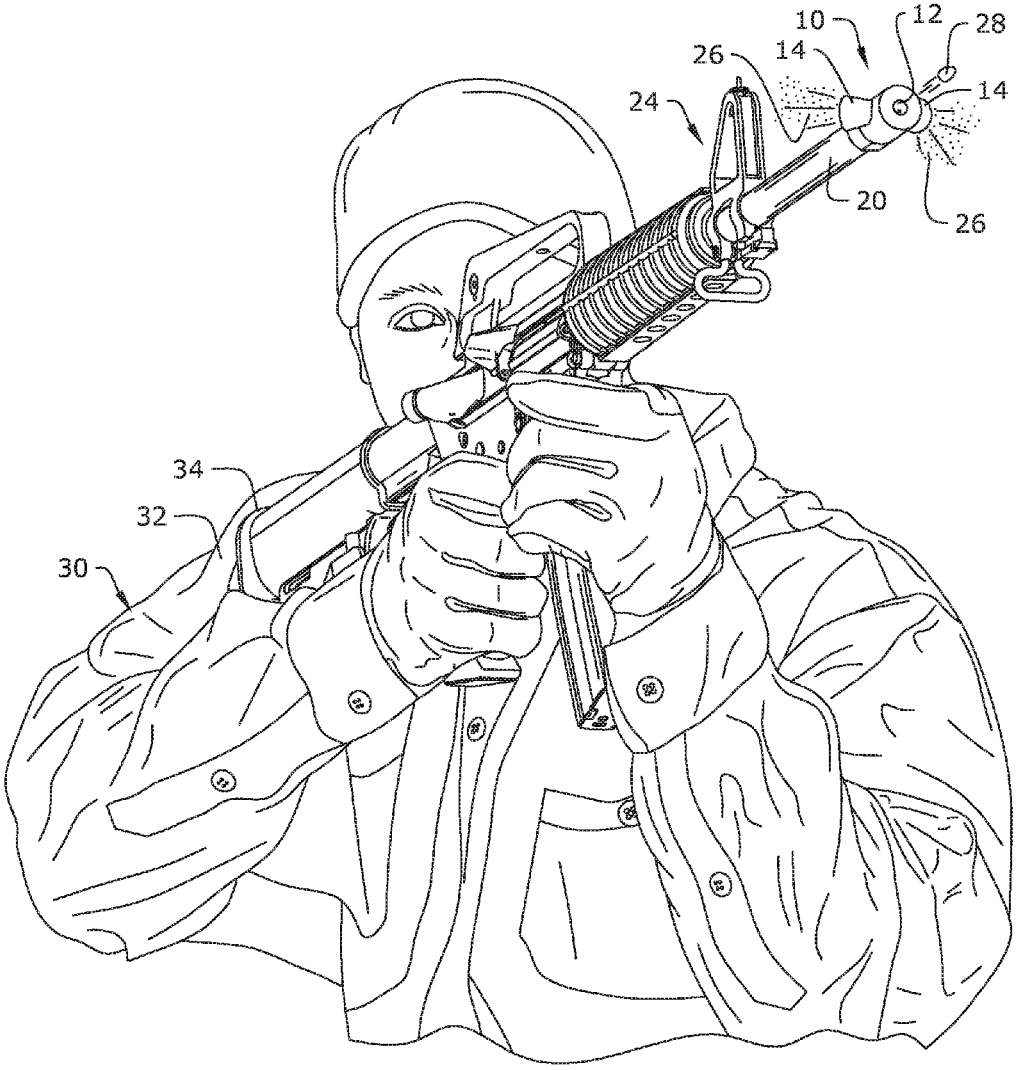
FIG. 1: is a perspective view of muzzle brake shown in use.

As seen in reference to FIG. 1, an embodiment of a muzzle brake 10 of the present invention is shown attached to the muzzle end of the barrel 20 of a firearm 24. The firearm 24 may include a stock 34 that is nested in the crook of a shooter's 30 shoulder 32 when the shooter 30 is holding the weapon 24 in the firing position. Upon firing the weapon 24, the bullet 28 is propelled through the barrel 20 by the rapidly expanding gasses released by the ignition of a combustible charge contained within, for example the ammunition cartridge.

As seen in reference to FIGS. 2-10, the muzzle brake 10 of the present invention is formed with a generally cylindrical body having an attachment end that, in use, is operatively coupled to the barrel 20 of the rifle 24. An opposite, firing end of the muzzle brake 10 is oriented coaxial with the barrel 20 to permit the bullet 28 to exit the barrel 20 when the weapon 24 is fired.

The muzzle brake 10 includes a bore 12 that extends through the body of the muzzle brake 10. As will be familiar to one of skill in the art of firearms, the bore 12 will have a diameter corresponding to the caliber of the ammunition round or bullet 28 which the weapon 24 is designed to fire.

Figure 2:
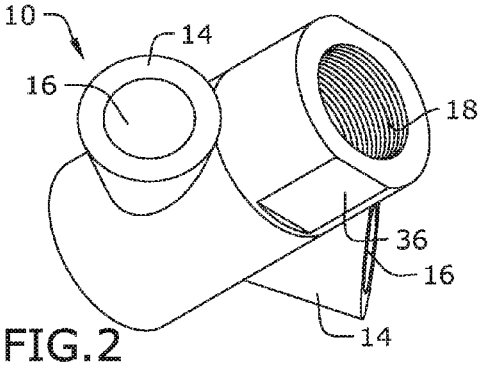
FIG. 2: is a bottom rear perspective view of the muzzle brake.
Figure 3:
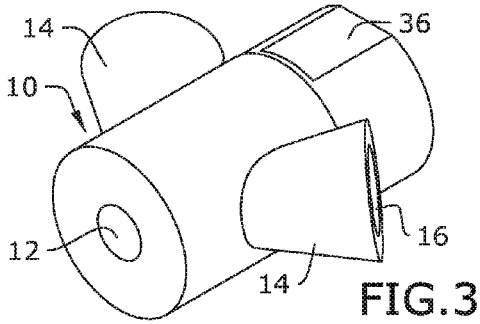
FIG. 3: is a top front perspective view of the muzzle brake.
Figure 4:
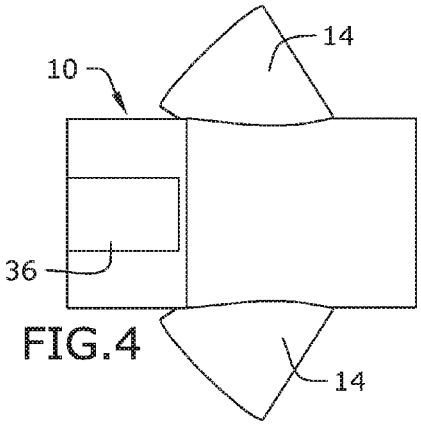
FIG. 4: is a bottom view of the muzzle brake.
Figure 5:
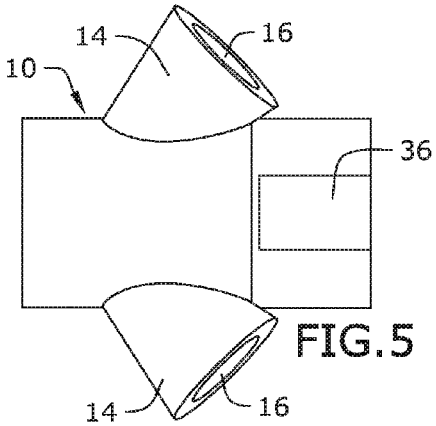
FIG. 5: is a top view of the muzzle brake.
Figure 6:
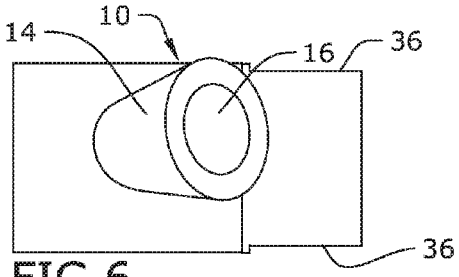
FIG. 6: is a side view of the muzzle brake.
Figure 7:
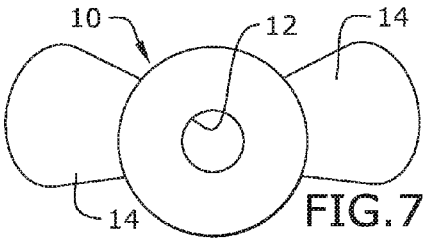
FIG. 7: is a front view of the muzzle brake.
Figure 8:
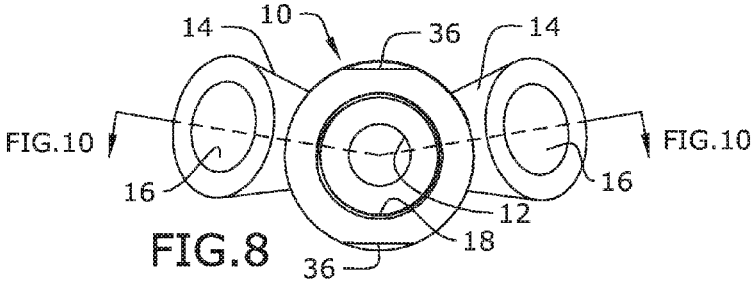
FIG. 8: is a rear view of the muzzle brake.
Figure 9:
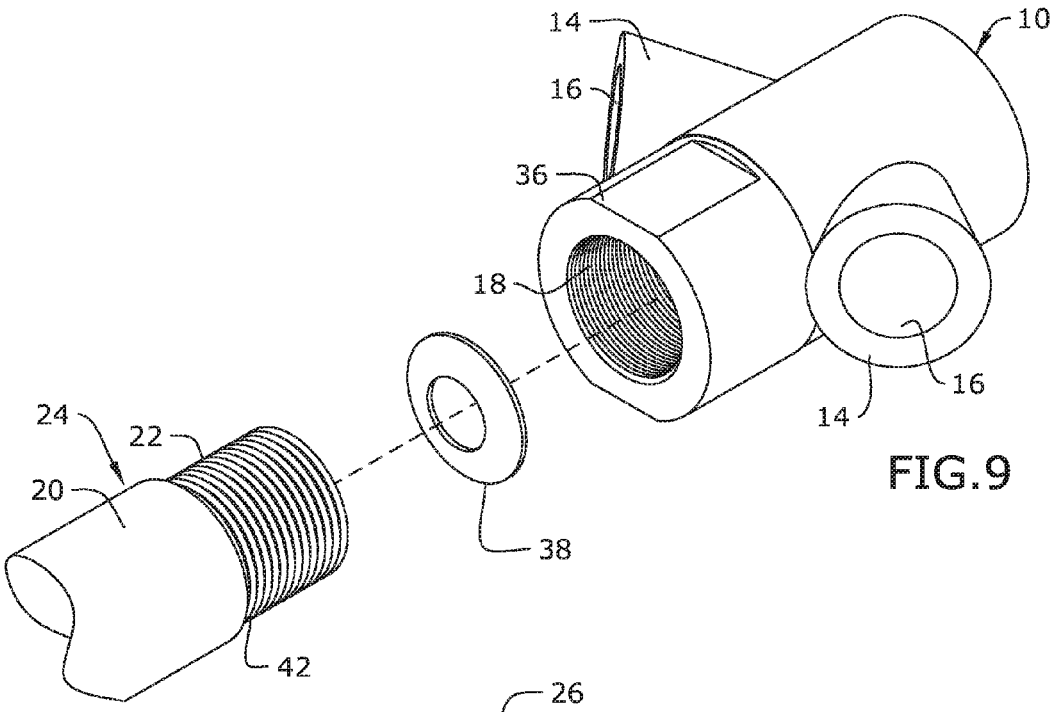
FIG. 9: is an exploded view of the muzzle brake illustrating an application to a weapon barrel.

As best seen in reference to FIGS. 2 and 9, the attachment end includes a threaded region 18 coaxially aligned with the bore 12 for threaded coupling of the muzzle brake 10 to a corresponding thread 22 on the end exit end of the rifle barrel 20. As illustrated, the threaded region 18 may be formed as length of female threads defined in an interior cavity of the muzzle brake bore 12. As best seen in reference to FIG. 10, a shoulder region 40 is in abutment with the end surface of the barrel 20 surrounding the bore 12. A corresponding male threaded region 22 is defined on the rifle barrel 20 for reception of the muzzle brake 10.

A crush washer 38 may be used between an end face of the muzzle brake attachment end and an annular shoulder formed at an aft end of the barrel threads 22. The attachment end portion of the muzzle brake 10 may also be provided with a plurality of flats 36 on opposed sides of the body for securely tightening the muzzle brake 10 to the barrel 20.

The muzzle brake 10 also includes a muzzle brake nozzle 16 defined in an interior cavity of a plurality muzzle brake protrusions 14 extending from opposed sides of the body of the muzzle brake 10. The muzzle brake protrusions 14 and internal nozzles 16 project rearward from the firing end of the weapon 24 and are oriented at an angle of between about 35 and 55 degrees from the longitudinal axis of the muzzle brake bore 12. More preferably, the protrusions 14 are oriented at an angle of about 45 degrees.

Figure 10:
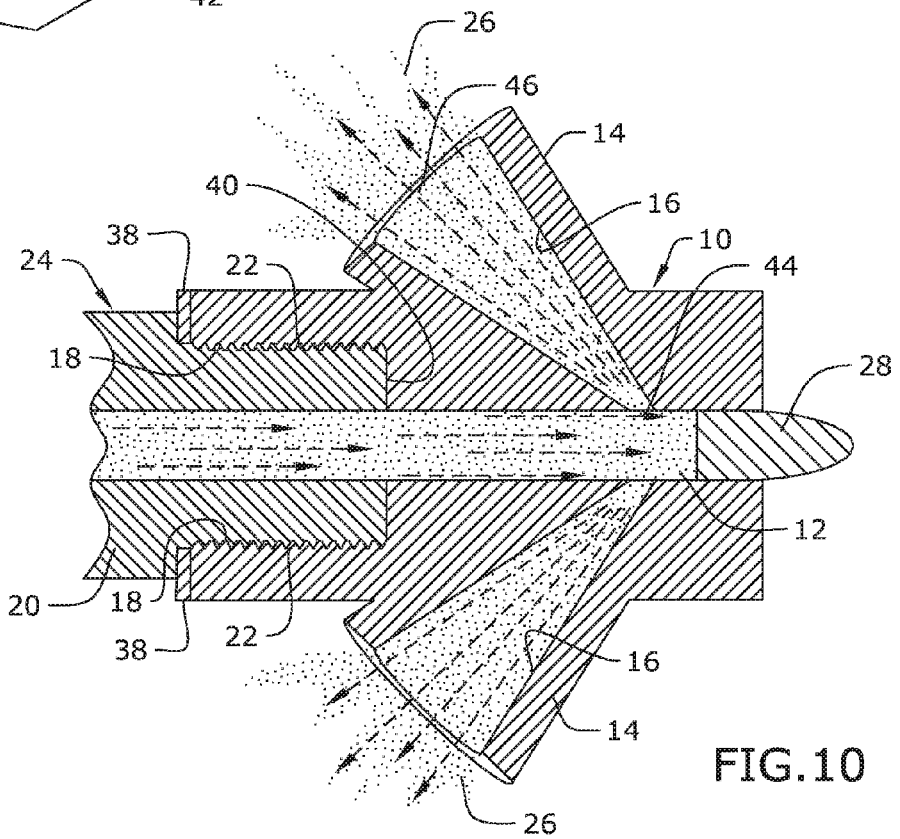
FIG. 10: is a multi-plane section detail view of muzzle brake taken along line 10-10 in FIG. 8 and shown use.

As best seen in reference to FIG. 10, the nozzles 16 are defined with divergent sidewalls to form a generally conic cavity, which may include a straight conic, parabolic, or other thrust producing sidewall shape. The nozzles 16 have a vertex aperture 44, or throat opening to the muzzle brake bore 12, diverging expansion section, and a base, or exit opening 46 at an end face of the protrusions 14. The vertex aperture 44 intersects the bore 12 at a position proximal to the firing end of the bore 12. Preferably the vertex aperture 44 is located at a point corresponding to the position of the aft end of the bullet 28 as the bullet base prepares to exit the bore 12, which may vary depending upon the caliber, grains, and configuration of the bullet or projectile round 28.

The angle of the nozzles 16 may range between about 8 and 15 degrees, optimally about 12 degrees about the central axis of the nozzle 16. The central axis of each nozzle 16 is preferably aligned to intersect the central longitudinal axis of the bore 12.

For weapons or weapon systems, where muzzle lift correction is required, the nozzles 16 and protrusions 14 may also be oriented at an upturned angle from the longitudinal axis of the bore 12. The upturned angle may range from between about 5 and 15 degrees, more preferably about 10 degrees.

In operation, the muzzle brake nozzles 16 are formed to generate a thrust when the bullet 28 passes the vertex aperture 44, or throat 44 of the muzzle brake 10. The thrust is formed by expansion and acceleration of the expanding propellant gasses as they pass through the throat 44 and transit the nozzle 16 to the nozzle exit 46. The rearward swept orientation of the nozzles 16 release and direct the rapidly expanding propellant gasses through the nozzles 16 so as to produce a thrust vector component to substantially counteract the recoil force of the weapon.

Due to the orientation and configuration of the nozzle 16 the thrust vector includes opposing lateral components, and a longitudinal resultant component that counteracts the weapon recoil. In embodiments of the muzzle brake 10 with the additional upswept orientation of the nozzle 16, the resultant thrust may include a vertical component that substantially counteracts the muzzle rise forces of the weapon.

When applied to a rifle barrel, the muzzle brake 10 of the present invention reduces over 70% of weapon recoil, compared to other muzzle brakes, which only remove 50% at best. As previously indicated, for large caliber weapon systems, a substantial portion of the weapon system's complexity, weight, and lifecycle costs are expended to provide a suitable carriage or mounting platform that can absorb and sustain the substantial recoil forces generated by these weapons systems.

The muzzle brake 10 may be formed as a casting, machining, or by 3D printing using selective laser sintering.

It should be understood, of course, that the foregoing relates to exemplary embodiments of the invention and that modifications may be made without departing from the spirit and scope of the invention as set forth in the following claims.

What is claimed is:

1. A muzzle brake comprising:

a generally cylindrical body having an attachment end portion and a firing end portion opposite the attachment end;

a bore defined through the generally cylindrical body and extending between the attachment end and the firing end;

a plurality of protrusions extending from a lateral surface of the generally cylindrical body; and a nozzle having diverging sidewalls defined in each of the plurality of protrusions, the nozzle having a throat proximal and in fluid communication with the bore and an exit distal from the firing end of the bore, wherein a longitudinal axis of the nozzle is aligned between about 35 to 55 degrees laterally from a longitudinal axis of said bore.

2. The muzzle brake of claim 1, wherein a longitudinal axis of the nozzle is aligned at about 45 degrees laterally from a longitudinal axis of said bore.

3. The muzzle brake of claim 1, wherein the diverging sidewalls have an angle of between about 8 to 15 degrees of elevation from a longitudinal axis of the nozzle.

4. The muzzle brake of claim 1, wherein the diverging sidewalls have an angle of about 12 degrees of elevation from a longitudinal axis of the nozzle.

5. The muzzle brake of claim 1, wherein a longitudinal axis of the nozzle is elevated between about 5 and 15 degrees of elevation from a longitudinal axis of said bore.

6. The muzzle brake of claim 1, wherein a longitudinal axis of the nozzle is elevated about 10 degrees from a longitudinal axis of said bore.

7. A muzzle brake comprising:

a generally cylindrical body having an attachment end portion and a firing end portion opposite the attachment end;

a bore defined through the generally cylindrical body and extending between the attachment end and the firing end;

a plurality of nozzles having diverging sidewalls, each of the plurality of nozzles extending through a cylindrical protrusion extending from opposed sides of the cylindrical body, the plurality of nozzles having a throat proximal and in fluid communication with the bore and an exit distal from the bore, wherein the plurality of nozzles are adapted to develop a thrust from a source of expanding gas passing through the throat from within the bore, the plurality of nozzles or to direct a first portion of the resultant thrust towards the firing end and a second portion of the resultant thrust downward.

8. The muzzle brake of claim 7, wherein a longitudinal axis of the plurality of nozzles intersect at the longitudinal axis of the bore.

9. The muzzle brake of claim 7, wherein the attachment end is adapted to receive the muzzle of a weapon barrel.

10. A muzzle brake comprising:

a generally cylindrical body having an attachment end portion and a firing end portion opposite the attachment end;

a bore defined through the generally cylindrical body and extending between the attachment end and the firing end;

a plurality of nozzles having diverging sidewalls, the plurality of nozzles extending through a lateral side of the cylindrical body, the plurality of nozzles having a throat proximal and in fluid communication with the bore and an exit opening distal from the bore and having a diameter larger than the throat, the plurality of nozzles having a longitudinal axis aligned to intersect a longitudinal axis of the bore near the firing end and extending rearward from the firing end; and wherein an axis of the plurality of nozzles is elevated with respect to the longitudinal axis of the bore between about 5-15 degrees, and laterally at an angle of between about 35-55 degrees from the longitudinal axis of the bore.

11. The muzzle brake of claim 10, wherein the wherein the plurality of nozzles are adapted to develop a thrust from a source of expanding gas passing through the throat from within the bore.

12. The muzzle brake of claim 11, wherein the throat is located at a point corresponding to the position of the aft end of a bullet as a base of the bullet base prepares to exit the bore.

* * * * *